United States Patent [19]

Dunn

[11] 4,086,979

[45] May 2, 1978

[54] SCAFFOLD LADDER ADAPTER

[76] Inventor: Lehmann M. Dunn, 5690 Lakeshore Rd., Port Huron, Mich. 48060

[21] Appl. No.: 775,726

[22] Filed: Mar. 9, 1977

[51] Int. Cl.[2] ..... E06C 1/36

[52] U.S. Cl. ..... 182/93; 182/206

[58] Field of Search ..... 182/93, 129, 206, 194; 248/210, 230, 231

[56] References Cited

U.S. PATENT DOCUMENTS

| | | | |
|---|---|---|---|
| 2,125,829 | 8/1938 | Uecker | 182/206 |
| 2,947,555 | 8/1960 | Olsen | 182/93 |
| 3,409,259 | 11/1968 | Cross | 248/230 |
| 3,853,202 | 12/1974 | Jarboe | 182/206 |
| 3,870,124 | 3/1975 | Howard | 182/93 |

FOREIGN PATENT DOCUMENTS

| | | | |
|---|---|---|---|
| 950,419 | 7/1974 | Canada | 182/214 |
| 1,355,507 | 2/1964 | France | 182/93 |

*Primary Examiner*—Reinaldo P. Machado
*Attorney, Agent, or Firm*—Barnes, Kisselle, Raisch & Choate

[57] ABSTRACT

A scaffold having a plurality of vertically spaced horizontal bars, a ladder having horizontal rungs and horizontally spaced vertical uprights, and a scaffold ladder adapter positioning the ladder adjacent the scaffold. The adapter comprises a bracket having spaced arms connected by a base telescoped over each upright of the ladder under a rung of the ladder. The ends of the arms are removably mounted on a horizontal bar of the scaffold and a strap individual to each bracket is disconnectably connected at the lower end to its respective bracket and at its upper end to a horizontal bar spaced vertically above the horizontal bar which is connected to the brackets.

13 Claims, 3 Drawing Figures

SCAFFOLD LADDER ADAPTER

This invention relates to scaffold and ladder construction and particularly to an adapter for positioning a ladder adjacent a scaffold.

BACKGROUND OF THE INVENTION

In the use of scaffolds for construction, repair and the like, it is common to provide a ladder adjacent the scaffold or as a part of the scaffold to facilitate the movement of the worker up and down on the scaffold.

Among the objects of the invention are to provide a scaffold ladder adapter which can be utilized with various kinds of ladders for holding them in position adjacent a scaffold; which adapter is easily assembled and disassembled; which is low in cost; and which utilizes a minimum number of parts.

SUMMARY OF THE INVENTION

In accordance with the invention, the scaffold ladder adapter comprises a bracket having spaced arms connected by a base telescoped over each upright of the ladder under a rung of the ladder. Means on the ends of the arms removably mount the arms with the horizontal bar of the scaffold, and a strap individual to each bracket has means disconnectably connecting the lower end of the strap to its respective bracket and means disconnectably connecting the upper end of the strap to a horizontal bar spaced vertically above the horizontal bar which is connected to the bracket.

DESCRIPTION

Figure 1:
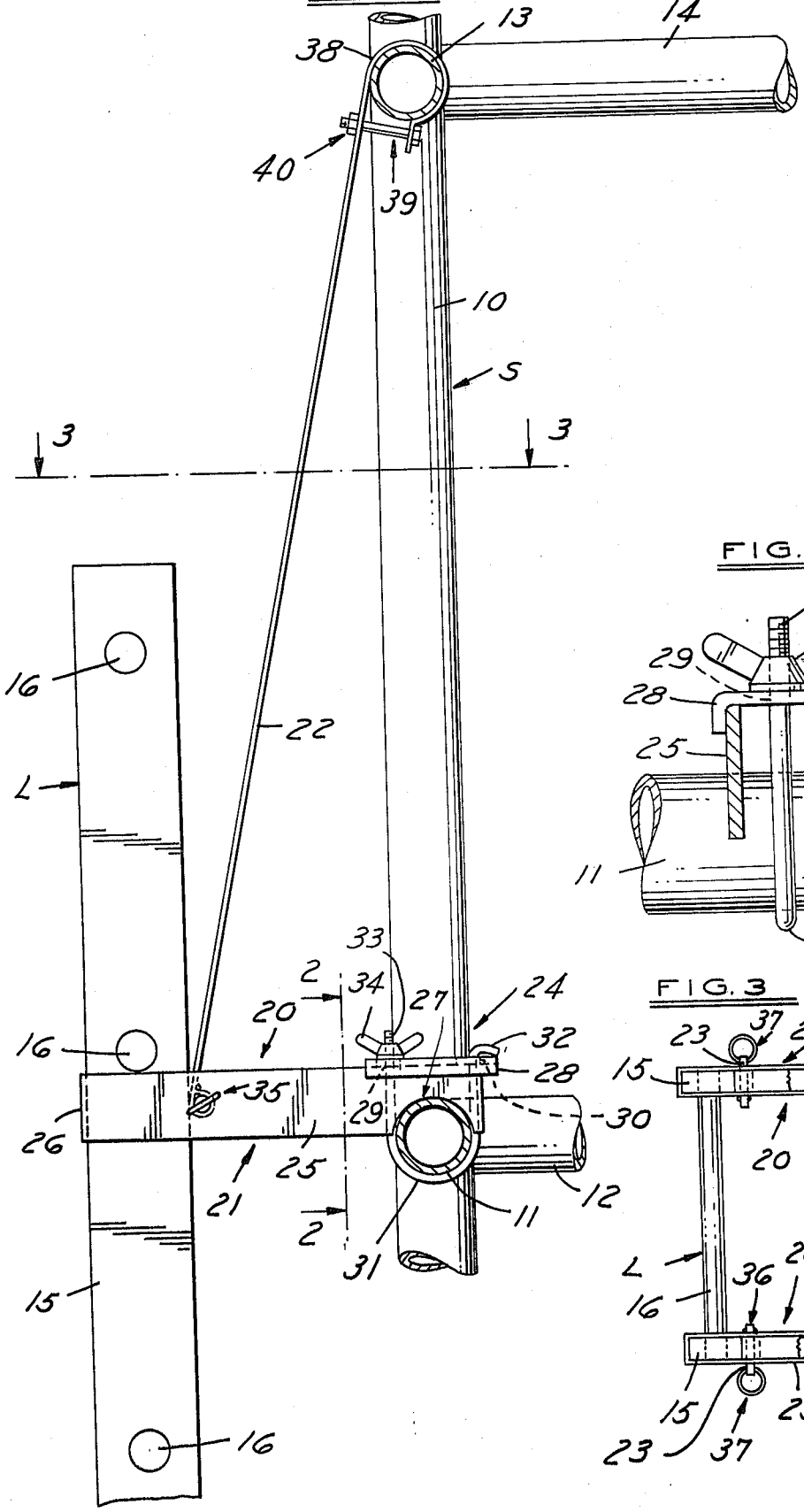
FIG. 1 is a fragmentary part sectional elevational view of an apparatus embodying the invention.
Figure 2:
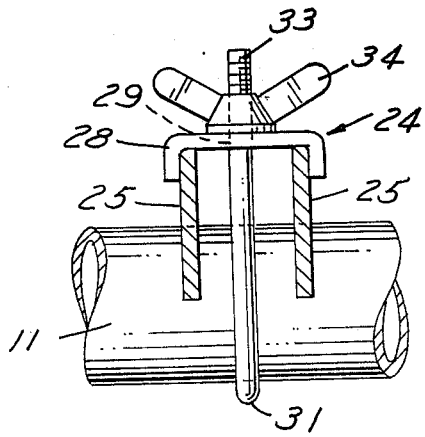
FIG. 2 is a fragmentary sectional view on an enlarged scale taken along the line 2—2 in FIG. 1.
Figure 3:
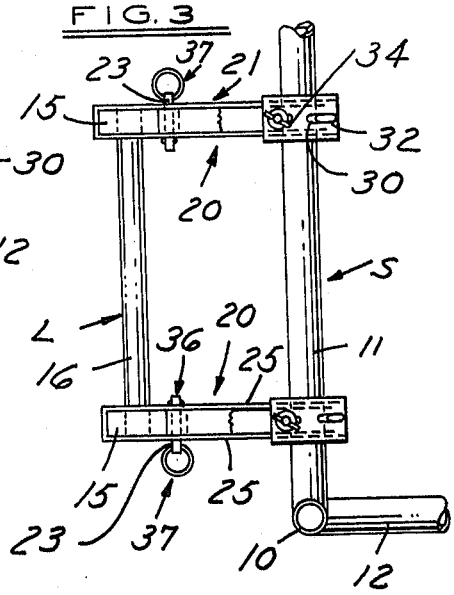
FIG. 3 is a fragmentary sectional view on a reduced scale taken along the line 3—3 in FIG. 1.

Referring to FIG. 1, the invention relates to a ladder L and a scaffold S and to a scaffold ladder adapter for positioning the ladder L adjacent the scaffold S. The scaffold S is of conventional construction and comprises vertical bars 10 and vertically spaced horizontal bars 11, 12, 13, 14, it being readily understood that only a part of a conventional scaffold is shown in the drawings. The ladder L is also of conventional construction and may be made of wood, aluminum, plastic or the like and comprises vertical uprights 15 and vertically spaced horizontal rungs 16. Each ladder L is preferably supported in position with the lower end thereof resting on the ground, or slightly above the ground, to allow movement of the scaffold by the use of a plurality of scaffold ladder adapters 20 each of which includes a bracket 21, a strap 22, pins 23 and a clamp assembly 24. Each bracket 21 includes spaced arms 25 connected by a base 26 and is preferably made of metal. Each arm 25 includes a recess 27 that engages over a horizontal bar 11 on the scaffold and has the same configuration, herein shown as semi-circular, to correspond to the circular cross section of the horizontal bar 11 of the scaffold S. The space between the arms 25 is slightly larger than the width of each vertical upright 15 of the ladder.

The free ends of the arms 25 are fastened to the horizontal bar 11 by clamp assembly 24 which includes a U-shaped plate 28 having spaced openings 29, 30 into which the ends of a U bolt 31 extend. One end is bent as at 32 and the other end is threaded as at 33 for a wing nut 34 that is tightened down onto a lock washer on the bolt and on the plate 28 to lock the end of the arm on the bar 11.

Each strap 22 is made of metal and includes an integral loop 35 which is disconnectably connected with the arms 25 by removable pin 23 extending through aligned openings in arms 25. Pin 23 has a loop 37 to facilitate insertion and removal. The upper end of each loop 22 is formed with a curved portion 38 that passes over a horizontal bar 13 of scaffold S above the bar 11. A bolt 39 extends through aligned openings in the free end of the strap 22 and adjacent portion of the strap 22, a lock washer is positioned on the end of the bolt and a nut 40 is threaded thereon to clamp the strap about the bar 13 of scaffold S. The brackets 21 are positioned beneath a rung 16. The position of the openings through which the pin 36 extends is such that the loop 35 of the strap 22 is adjacent the rung 15 and thereby prevents lateral movement of the ladder L. In use, a scaffold adapter bracket is provided adjacent the lower end of the ladder and additional scaffold adapter brackets are mounted at longitudinally spaced points along the ladder. Some or all of the additional brackets may not have the straps 22 and associated connections.

When the scaffold ladder adapter is in position, the ladder is held firmly adjacent the scaffold S so that a worker can readily move to and from positions on the scaffold. If the ladder is very long, additional scaffold ladder adapters may be provided at vertically spaced points to position and stabilize the ladder.

Since the scaffold ladder adapter can be connected and disconnected without the use of tools except for possibly the loosening of the nut 40, the ladder can be readily disconnected and moved to a more appropriate position on the scaffold as required. As a result, the danger to the worker by having the ladder in inappropriate position is lessened.

I claim:

1. The combination comprising a scaffold having a plurality of vertically spaced horizontal bars, a ladder having horizontal rungs and vertically spaced uprights, and a scaffold ladder adapter comprising a bracket having spaced arms connected by a base positioned on each upright of the ladder under a rung of the ladder, means on the ends of said arms for disconnectably connecting said arms with said horizontal bar of said scaffold, a strap individual to each said bracket, means for disconnectably connecting the lower end of each strap to its respective bracket, and means for disconnectably connecting the upper end of each strap to a horizontal bar spaced vertically above the horizontal bar which is connected to said bracket.

2. The combination set forth in claim 1 wherein each said arm of said bracket has a recess therein conforming with the configuration of the horizontal bar of the scaffold.

3. The combination set forth in claim 2 wherein said means disconnectably connecting the arms to said horizontal bar comprises a plate, a U-shaped bolt, said bolt having a hook at one end and the other end thereof threaded, said plate having spaced openings adapted to be engaged by said hook and said threaded end respectively and a nut threaded on said threaded end of said bolt and engaging said plate.

4. The combination set forth in claim 1 wherein said means for disconnectably connecting the lower end of each said strap with said bracket comprises a loop formed on the lower end thereof, a pin, the arms of said bracket having aligned openings adjacent said ladder, whereby said pin extends through said loop and said aligned openings adjacent said ladder and holds the lower end of said strap with respect to said bracket and holds the ladder against lateral movement by cooperation with the base of said bracket.

5. The combination set forth in claim 1 wherein said means for disconnectably engaging the strap to said second horizontal bar of the scaffold comprises a bent portion on said strap having a free end and means extending between the free end of said strap and another portion of said strap for holding said upper end against movement with respect to said horizontal bar of said scaffold.

6. The combination set forth in claim 5 wherein said last-mentioned means comprises a bolt and nut extending through aligned openings in the end of the strap and the strap adjacent said horizontal bar.

7. A scaffold ladder adapter comprising a bracket having spaced arms connected by a base adapted to be positioned over an upright of a ladder, means on the ends of said arms for disconnectably connecting said arms with a horizontal bar of a scaffold, and a strap individual to each said bracket, means for disconnectably connecting the lower end of each strap to its respective bracket, and means for disconnectably connecting the upper end of each strap to a horizontal bar spaced vertically above the horizontal bar which is connected to said bracket.

8. The combination set forth in claim 7 wherein each said arm of said bracket has a recess therein adapted to conform with the configuration of the horizontal bar of the scaffold.

9. The combination set forth in claim 8 wherein said means disconnectably connecting the arms to said horizontal bar comprises a plate, a U-shaped bolt, said bolt having a hook at one end and the other end thereof threaded, said plate having spaced openings adapted to be engaged by said hook and said threaded end respectively and a nut threaded on said threaded end of said bolt and engaging said plate.

10. The combination set forth in claim 7 wherein said means for disconnectably connecting the lower end of each said strap with said bracket comprises a loop formed on the lower end thereof.

a pin, said bracket having openings spaced from said base of said bracket, whereby said pin extends through said loop and said aligned openings adjacent said ladder and holds the lower end of each said strap with respect to said bracket and holds the rung of the ladder against lateral movement by cooperation with the base of said bracket.

11. The combination set forth in claim 9 wherein said means for disconnectably engaging the strap to a second horizontal bar of a scaffold comprises a bent portion on said strap having a free end and means extending between the free end of said strap and another portion of said strap for holding said upper end against movement with respect to said horizontal bar of said scaffold.

12. The combination set forth in claim 11 wherein said last-mentioned means comprises a bolt and nut extending through aligned openings in the end of the strap and the strap adjacent said horizontal bar.

13. The combination comprising a scaffold having a plurality of vertically spaced horizontal bars, a ladder having horizontal rungs and vertically spaced uprights, and a scaffold ladder adapter comprising a bracket having spaced arms connected by a base positioned on each upright of the ladder under a rung of the ladder, means on the ends of said arms for disconnectably connecting said arms with said horizontal bar of said scaffold, a strap individual to each said bracket, means for disconnectably connecting the lower end of each strap to its respective bracket, and means for disconnectably connecting the upper end of each strap to a horizontal bar spaced vertically above the horizontal bar which is connected to said bracket, and a plurality of substantially identical brackets at longitudinally spaced points along said ladder, each said additional bracket engaging a rung in a substantially identical manner.

* * * * *